US008419122B2

(12) United States Patent
Lawson et al.

(10) Patent No.: US 8,419,122 B2
(45) Date of Patent: Apr. 16, 2013

(54) ZERO-WALL CLEARANCE LINKAGE MECHANISM FOR A HIGH-LEG SEATING UNIT

(75) Inventors: Gregory M. Lawson, Tupelo, MS (US); Robert Dean Donovan, Mooreville, MS (US)

(73) Assignee: L & P Property Management Company, South Gate, CA (US)

( * ) Notice: Subject to any disclaimer, the term of this patent is extended or adjusted under 35 U.S.C. 154(b) by 111 days.

(21) Appl. No.: 12/981,186

(22) Filed: Dec. 29, 2010

(65) Prior Publication Data

US 2011/0181094 A1 Jul. 28, 2011

Related U.S. Application Data

(60) Provisional application No. 61/298,209, filed on Jan. 25, 2010.

(51) Int. Cl.
*A47C 1/035* (2006.01)
*A47C 3/027* (2006.01)

(52) U.S. Cl.
USPC ..... 297/85 M; 297/259.2

(58) Field of Classification Search ..... 297/85 M, 297/259.2
See application file for complete search history.

(56) References Cited

U.S. PATENT DOCUMENTS

| | | | | |
|---|---|---|---|---|
| 78,304 | A | 5/1868 | Martin | |
| 2,452,140 | A | 10/1948 | Panter | |
| 3,243,226 | A | 3/1966 | Katz | |
| 3,937,518 | A | 2/1976 | Harrison | |
| 4,291,913 | A | 9/1981 | Kowalski | |
| 5,072,988 | A | 12/1991 | Plunk | |
| 5,088,473 | A | 2/1992 | Chen et al. | |
| 5,120,107 | A | 6/1992 | Rogers, Jr. | |
| 5,971,475 | A | 10/1999 | Lawson et al. | |
| 6,000,758 | A * | 12/1999 | Schaffner et al. | 297/84 X |
| 7,543,885 | B2 * | 6/2009 | Pollard et al. | 297/85 M X |
| 7,997,644 | B2 * | 8/2011 | Hoffman et al. | 297/85 M |
| 8,016,348 | B2 * | 9/2011 | Hoffman et al. | 297/85 M |

(Continued)

OTHER PUBLICATIONS

Notification of Transmittal of International Preliminary Examination Report in PCT/US11/20389. mailed Feb. 27, 2012, 14 pages.

(Continued)

*Primary Examiner* — Rodney B White
(74) *Attorney, Agent, or Firm* — Shook, Hardy & Bacon L.L.P.

(57) ABSTRACT

Provided is a linkage mechanism for a recliner that includes a seat-mounting plate, a base plate that is vertically supported by one or more legs, a footrest assembly adapted to extend ottoman(s) when the recliner is adjusted from a closed to an extended position, and a front lift assembly. The front lift assembly includes a front bellcrank that is rotatably coupled to the seat-mounting plate, a front pivot link that is rotatably coupled to the base plate, a carrier link that is pivotably coupled to the front pivot link and to the front bellcrank, and a front lift link that is rotatably coupled to the seat-mounting plate and is pivotably coupled to the front lift link. Additionally, the linkage mechanism includes a seat-adjustment assembly that cooperates with the front lift assembly to translate the seat-mounting plate over the base plate during adjustment between extended and reclined positions.

20 Claims, 12 Drawing Sheets

U.S. PATENT DOCUMENTS

| | | | | |
|---|---|---|---|---|
| 8,113,574 | B2 * | 2/2012 | Hoffman et al. | 297/85 M |
| 2004/0051350 | A1 | 3/2004 | Duncan et al. | |
| 2006/0273631 | A1 | 12/2006 | White et al. | |
| 2009/0278395 | A1 * | 11/2009 | Pollard et al. | 297/85 M |
| 2012/0153704 | A1 * | 6/2012 | Hoffman et al. | 297/85 M |

OTHER PUBLICATIONS

International Search Report of PCT/US2011/020389 dated Mar. 14, 2011.

* cited by examiner

FIG. 14
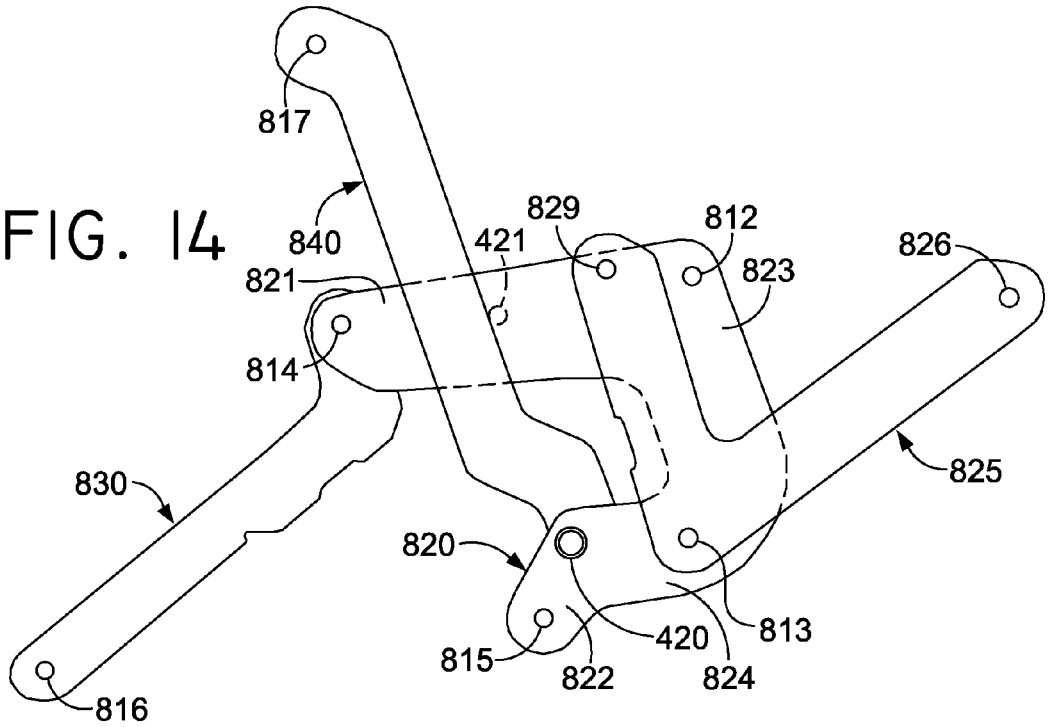
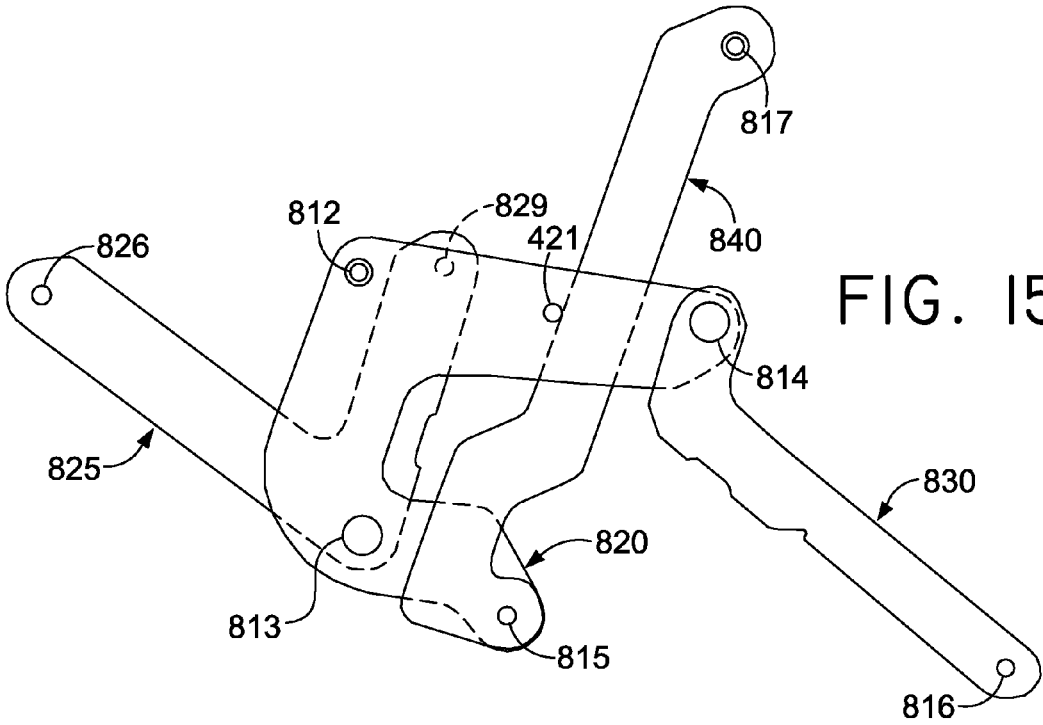
FIG. 15

ZERO-WALL CLEARANCE LINKAGE MECHANISM FOR A HIGH-LEG SEATING UNIT

CROSS-REFERENCE TO RELATED APPLICATIONS

This application claims the benefit of U.S. Provisional Application No. 61/298,209, filed Jan. 25, 2010, entitled "ZERO-WALL CLEARANCE LINKAGE MECHANISM FOR A HIGH-LEG SEATING UNIT," herein incorporated by reference.

BACKGROUND OF THE INVENTION

The present invention relates broadly to motion upholstery furniture designed to support a user's body in an essentially seated disposition. Motion upholstery furniture includes recliners, incliners, sofas, love seats, sectionals, theater seating, traditional chairs, and chairs with a moveable seat portion, such furniture pieces being referred to herein generally as "seating units." More particularly, the present invention relates to an improved linkage mechanism developed to accommodate a wide variety of styling for a seating unit (e.g., high-leg chairs), which is otherwise limited by the configurations of linkage mechanisms in the field. Additionally, the improved linkage mechanism of the present invention provides for reclining a seating unit that is positioned against a wall or within close proximity of other fixed objects.

Reclining seating units exist that allow a user to forwardly extend a footrest and to recline a backrest rearward relative to a seat. These existing seating units typically provide three basic positions: a standard, non-reclined closed position; an extended position; and a reclined position. In the closed position, the seat resides in a generally horizontal orientation and the backrest is disposed substantially upright. Additionally, if the seating unit includes one or more ottomans attached with a mechanical arrangement, the mechanical arrangement is collapsed such that the ottoman(s) are not extended. In the extended position, often referred to as a television ("TV") position, the ottoman(s) are extended forward of the seat, and the backrest remains sufficiently upright to permit comfortable television viewing by an occupant of the seating unit. In the reclined position the backrest is pivoted rearward from the extended position into an obtuse relationship with the seat for lounging or sleeping.

Several modern seating units in the industry are adapted to provide the adjustment capability described above. However, these seating units require relatively complex linkage mechanisms to afford this capability. The complex linkage assemblies limit certain design aspects utilized by furniture manufacturers. In one instance, these linkage assemblies impose constraints on an upholstery designer's use of multiple styling features concurrently on an adjustable seating unit. For instance, these linkage assemblies are bulky and require seating units to incorporate space-saving features (connecting the linkage mechanisms to a base resting on the floor), thereby hiding the linkage assemblies below the seat when in the closed position. But, these space-saving features preclude a furniture designer from providing the seating unit configured with arms that rest either directly or indirectly, via the support of high legs, on an underlying surface.

In another instance, these linkage assemblies impose constraints on incorporating a single motor for automating adjustment between the positions mentioned above, and require two or more motors to accomplish automation of each adjustment. For instance, achieving a full range of motion when automatically adjusting between positions conventionally requires a plurality of large motors each with a substantial stroke. (The geometry of the linkage assembly prohibits mounting a single large motor thereto without interfering with crossbeams, the underlying surface, or moving parts attached to the linkage assembly.) As such, a more refined linkage mechanism that achieves full movement when being automatically adjusted between the closed, extended, and reclined positions would fill a void in the current field of motion-upholstery technology.

Accordingly, embodiments of the present invention pertain to a novel linkage mechanism that allows a seating unit to provide the features of a design that overcomes the need for considerable wall clearance and allows for high-leg capability. Further, the linkage mechanisms of the present invention are constructed in a simple and compact arrangement in order to provide function without impairing incorporation of desirable upholstery features.

BRIEF SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Generally, embodiments of the present invention seek to provide a simplified, compact linkage mechanism that can be adapted to essentially any type of seating unit. In particular embodiments, the present invention seeks to provide a linkage mechanism that can be assembled to a compact motor and that can be adapted to essentially any type of seating unit. In operation, the compact motor in concert with the linkage mechanism can achieve full movement of the seating unit between the closed, extended, and reclined positions. The compact motor may be employed in a proficient and cost-effective manner to adjust the linkage mechanism without creating interference or other disadvantages (e.g., preclusion of adaption to high-leg models) appearing in conventional designs that are inherent with automation.

As more fully discussed below, embodiments of seating unit introduced by the present invention include the following components: first and second foot-support ottomans; a seat; a backrest; a pair of base plates in substantially parallel-spaced relation; a pair of seat-mounting plates in substantially parallel-spaced relation; a seating support surface extending between the seat-mounting plates; and a pair of the generally mirror-image linkage mechanisms that interconnect the base plates to the seat-mounting plates, respectively. Additionally, the seat-mounting plates support the seat via the seating support surface, which is disposed in an inclined orientation in relation to a surface underlying the seating unit. In operation, the linkage mechanisms are adapted to move between the closed position, the extended position, and the reclined position while maintaining the inclined orientation of the seat substantially consistent throughout adjustment.

Typically, the linkage mechanisms include a pair of footrest assemblies that movably interconnect the first and second foot-support ottomans to the seat-mounting plates. In operation, the footrest assemblies are adapted to extend and retract the ottomans when adjusting the seating unit between the extended and closed positions, respectively. Advantageously, during operation, the set of linkages comprising the footrest assembly are adapted to collapse to the closed position such that each member of the set of linkages is located below the seating support surface, yet above a lower surface of crossbeam support(s) connecting the base plates, which are raised above the underlying surface. This collapsed configuration of the footrest assembly reduces the set of linkages to a compact size such that the seating unit can incorporate high legs (e.g., legs of a traditional chair) while still hiding the linkage mechanism when adjusted to the closed position.

In addition, the linkage mechanisms each include a seat-adjustment assembly and a front lift assembly. These two assemblies function in concert to translate a respective seat-mounting plate over a respective base plate during adjustment of the seating unit. In an exemplary embodiment, the seat-adjustment assembly includes a rear bellcrank and the front lift assembly includes a front lift link. A rear control link is provided to inter-couple the rear bellcrank and the front lift assembly such that, during adjustment, the seating support surface may be biased at a particular inclination angle when translated forward and rearward.

In embodiments, the linkage mechanisms of the present invention are adapted to adjust a seating unit between closed, extended, and reclined positions. Typically, each of the linkage mechanisms include a seat-mounting plate adapted to accommodate a seat of the seating unit and a base plate that is vertically supported by one or more legs above an underlying surface. Each linkage mechanism may further include a footrest assembly adapted to extend and retract at least one ottoman when the seating unit is adjusted between the extended and closed positions and a front lift assembly. In one instance, the front lift assembly includes a front bellcrank that is rotatably coupled to the seat-mounting plate, a front pivot link that is rotatably coupled to the base plate, a carrier link that is pivotably coupled to the front pivot link and to the front bellcrank, and a front lift link that is rotatably coupled to the seat-mounting plate and is pivotably coupled to the front pivot link.

Typically, each linkage mechanism also includes a seat-adjustment assembly that operates in cooperation with the front lift assembly to translate the seat-mounting plate over the base plate during adjustment between the closed, extended, and reclined positions while maintaining a substantially consistent angle of inclination therebetween. In one embodiment, the seat-adjustment assembly includes a back-mounting link configured to accommodate a backrest of the seating unit, a rear pivot link that is rotatably coupled to the base plate, a back control link that is pivotably coupled to the back-mounting link, a rear bellcrank that is rotatably coupled to a downwardly extending member of the seat-mounting plate and is pivotably coupled to the back control link and to the rear pivot link, and a rear control link that is pivotably coupled to the front lift link and to the rear bellcrank.

BRIEF DESCRIPTION OF THE SEVERAL VIEWS OF THE DRAWING

In the accompanying drawings which form a part of the specification and which are to be read in conjunction therewith, and in which like reference numerals are used to indicate like parts in the various views:

FIG. 14 is a view similar to FIG. 12, but in the reclined position, in accordance with an embodiment of the present invention; and FIG. 15 is a view similar to FIG. 14, but from a vantage point internal to the recliner.

DETAILED DESCRIPTION OF THE INVENTION

Figure 1:
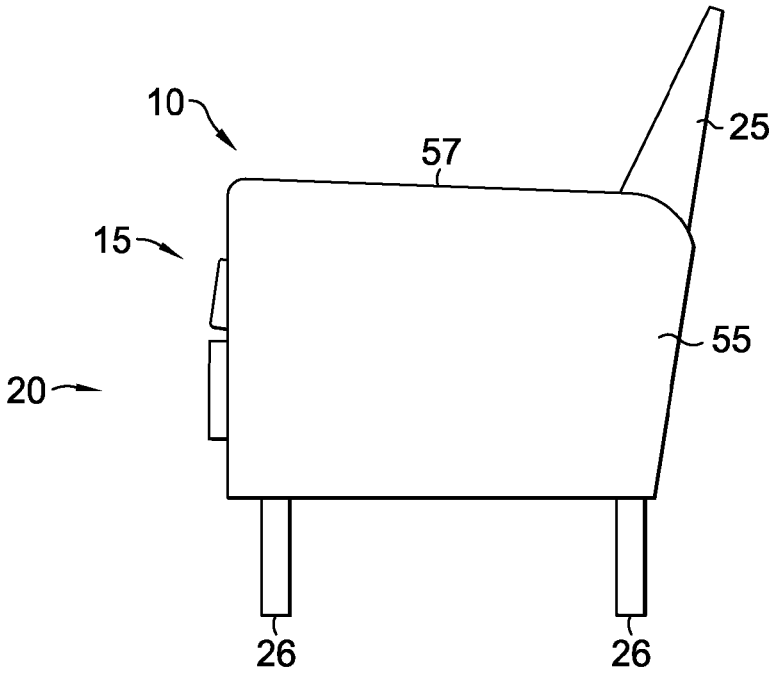
FIG. 1 is a diagrammatic lateral view of a recliner in a closed position, in accordance with an embodiment of the present invention.
Figure 2:
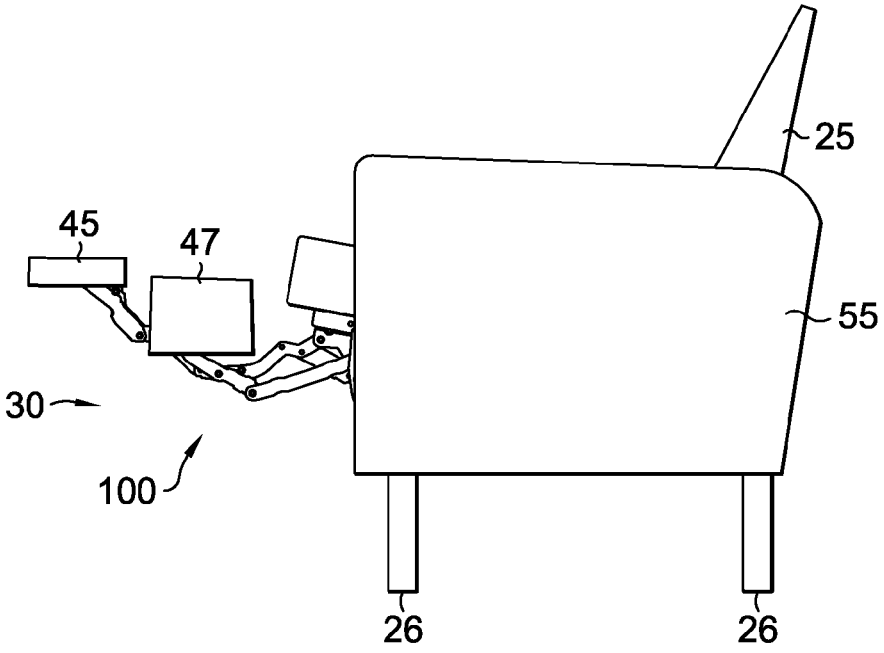
FIG. 2 is a view similar to FIG. 1, but in an extended position, in accordance with an embodiment of the present invention.
Figure 3:
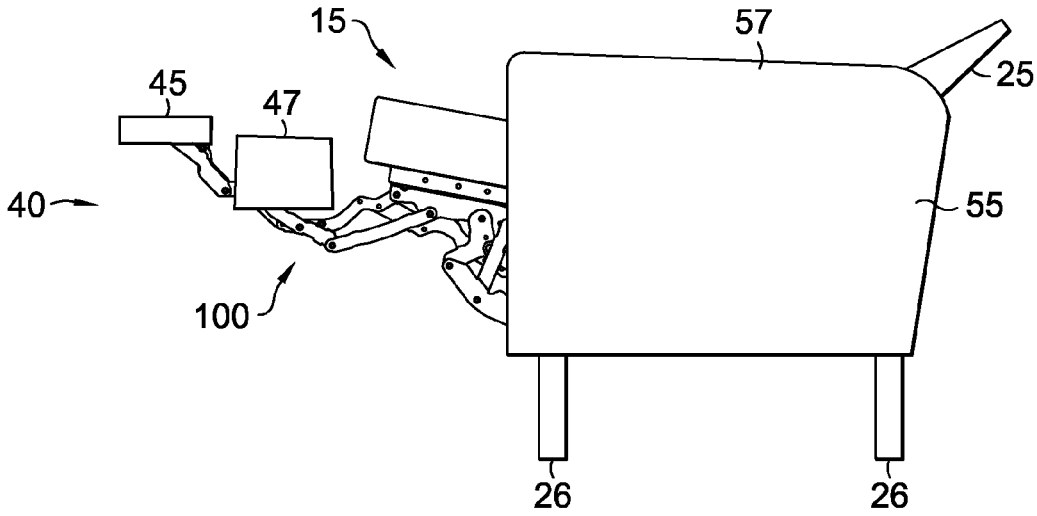
FIG. 3 is a view similar to FIG. 1, but in a reclined position with opposed arms attached to a stationary base, in accordance with an embodiment of the present invention.

FIGS. 1-3 illustrate a seating unit 10. Seating unit 10 has a seat 15, a backrest 25, legs 26, a linkage mechanism 100, a first foot-support ottoman 45, a second foot-support ottoman 47, and a pair of opposed arms 55. Opposed arms 55 are laterally spaced and have an arm-support surface 57 that is substantially horizontal. The opposed arms 55 are supported by the legs 26, which raise it above an underlying surface (not shown). In addition, with respect to a frame-within-a-frame style chair, the opposed arms 55 are interconnected to the seat 15 via the linkage mechanism 100 that is generally disposed between the opposed arms (i.e., substantially above a lower edge of the opposed arms). In this embodiment, the seat 15 is moveable between the opposed arms 55 during adjustment of the seating unit 10. Typically, the seat 15 is moveable according to the arrangement of the linkage mechanism 100 such that no portion of the seat 15 interferes with the opposed arms 55 throughout adjustment.

With respect to a pivot-over-arm style chair, not shown in the figures, the opposed arms 55 are actually connected with the seat 15. Further, in this embodiments, the legs 26 do not support the opposed arms 55. Instead, the legs 26 support an underlying frame of the seating unit 10, such that the seat 15 is not movable between the opposed arms 55.

In one embodiment, the backrest 25 extends from a rearward section of the seating unit 10 and is rotatably coupled to the linkage mechanism 100, typically proximate to the arm-support surface 57. First foot-support ottoman 45 and the second foot-support ottoman 47 are moveably supported by the linkage mechanism 100. The linkage mechanism 100 is arranged to articulably actuate and control movement of the seat 15, the backrest 25, and the ottomans 45 and 47 between the positions shown in FIGS. 1-3, as more fully described below.

As shown in FIGS. 1-3, the seating unit 10 is adjustable to three basic positions: a closed position 20, an extended position 30 (i.e., TV position), and the reclined position 40. FIG. 1 depicts the seating unit 10 adjusted to the closed position 20, which is a normal non-reclined sitting position with the seat 15 residing in a generally horizontal position and the backrest 25 generally upright and in a substantial perpendicular biased relation to the seat 15. In a particular configuration, the seat 15 is disposed in a slightly inclined orientation relative to the arm-support surface 57. In this embodiment, the inclined orientation may be maintained throughout adjustment of the seating unit 10. In addition, when adjusted to the closed position 20, the ottomans 45 and 47 and the linkage mechanism 100 are positioned below the seat 15; however, the linkage mechanism 100 does not visibly extend below the opposed arms 55.

Turning to FIG. 2, the extended position 30, or TV position, will now be described. When the seating unit 10 is adjusted to the extended position, the first foot-support ottoman 45 and the second foot-support ottoman 47 are extended forward of the opposed arms 55 and disposed generally horizontal. The backrest 25 continues to reside in a substantially perpendicular relationship to the seat 15 and does not encroach an adjacent wall. Also, the seat 15 is maintained in the inclined orientation relative to the arm-support surface 57. Thus, the configuration of the seating unit 10 in the extended position 30 provides an occupant a reclined TV position while providing space-saving utility. Typically, with respect to a frame-within-a-frame style chair, the seat 15 is translated slightly forward and downward relative to the opposed arms 55. However, in a pivot-over-arm style chair, the opposed arms 55 move with the seat 15. Yet, both styles mentioned above have substantially similar seat movement (i.e., forward and downward relative to the floor or legs 26 or anything else stationary). This movement of the seat 15 allows for a variety of styling to be incorporated into the seat 15, such as T-cushion styling.

FIG. 3 depicts the reclined position 40, in which the seating unit 10 is fully reclined. As discussed above, the legs 26 may extend downward from the opposed arms 55, thereby maintaining the arm-support surface 57 of the opposed arms 55 in a consistent position and orientation during adjustment of the seating unit 10 (not so for a POA). In contrast, during adjustment to the reclined position 40, the backrest 25 is rotated rearward by the linkage mechanism 100 and biased in a rearward inclination angle, while the ottomans 45 and 47 may be moved farther forward and upward from their position in the extended position 30.

The rearward inclination angle of the backrest 25, upon adjustment to the reclined position 40, is typically an obtuse angle in relation to the seat 15. However, the rearward inclination angle of the backrest 25 is typically offset by a forward and upward translation of the seat 15 as controlled by the linkage mechanism 100. This combination of movements is distinct from the operation of conventional reclining chairs that are equipped with three-position mechanisms. Specifically, conventional reclining chairs allow their backrest to rotate rearward during adjustment without providing any forward translation of the backrest, thereby requiring that the conventional reclining chairs be positioned a considerable distance from an adjacent rear wall or other proximate fixed objects. Advantageously, in embodiments of the present invention, the forward and upward translation of the seat 15 in conjunction with the rearward recline of the backrest 25 allow for zero-wall clearance. Generally, the phrase "zero-wall clearance" is utilized herein to refer to space-saving utility that permits positioning the seating unit 10 in close proximity to an adjacent rear wall and other fixed objects, while avoiding interference with the wall or the objects when adjusting into the reclined position 40.

Figure 5:
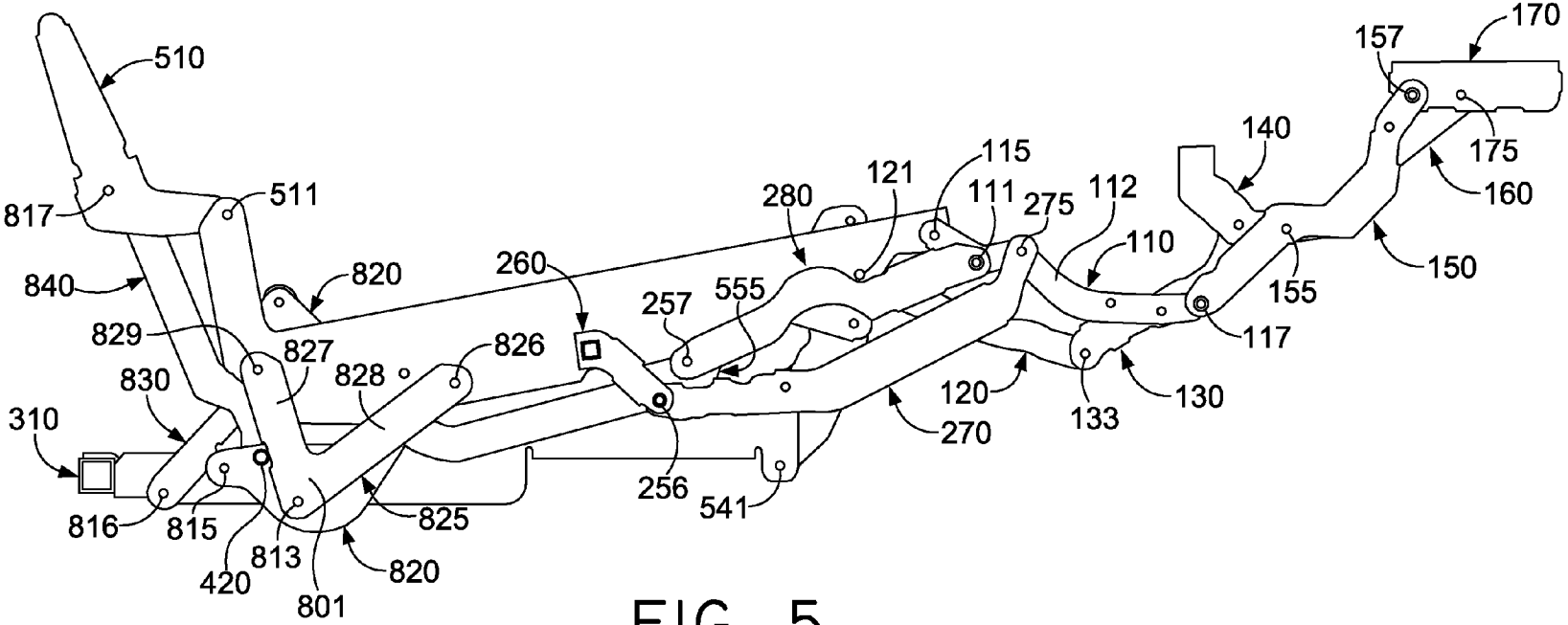
FIG. 5 is a diagrammatic lateral view of the automated linkage mechanism in the extended position from a vantage point internal to the recliner, in accordance with an embodiment of the present invention.
Figure 6:
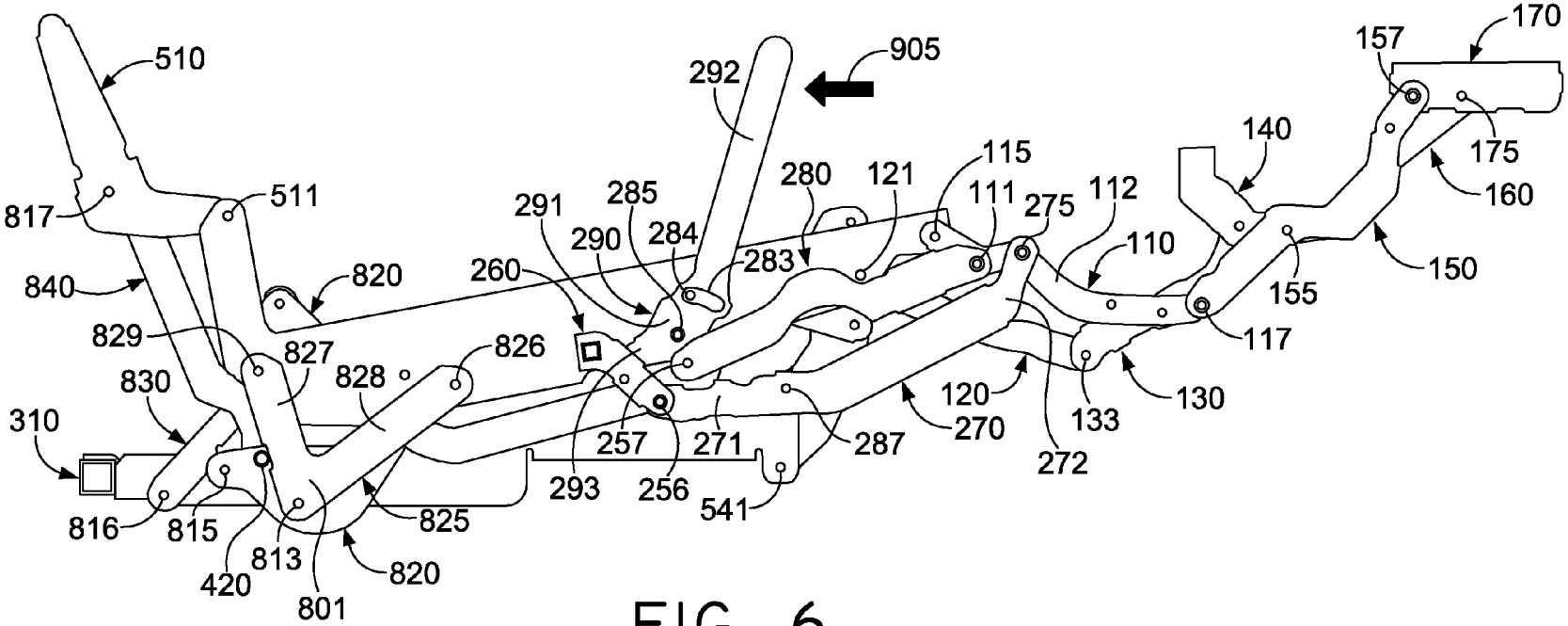
FIG. 6 is a view similar to FIG. 5, but illustrating a manually operated linkage mechanism, in accordance with an embodiment of the present invention.
Figure 7:
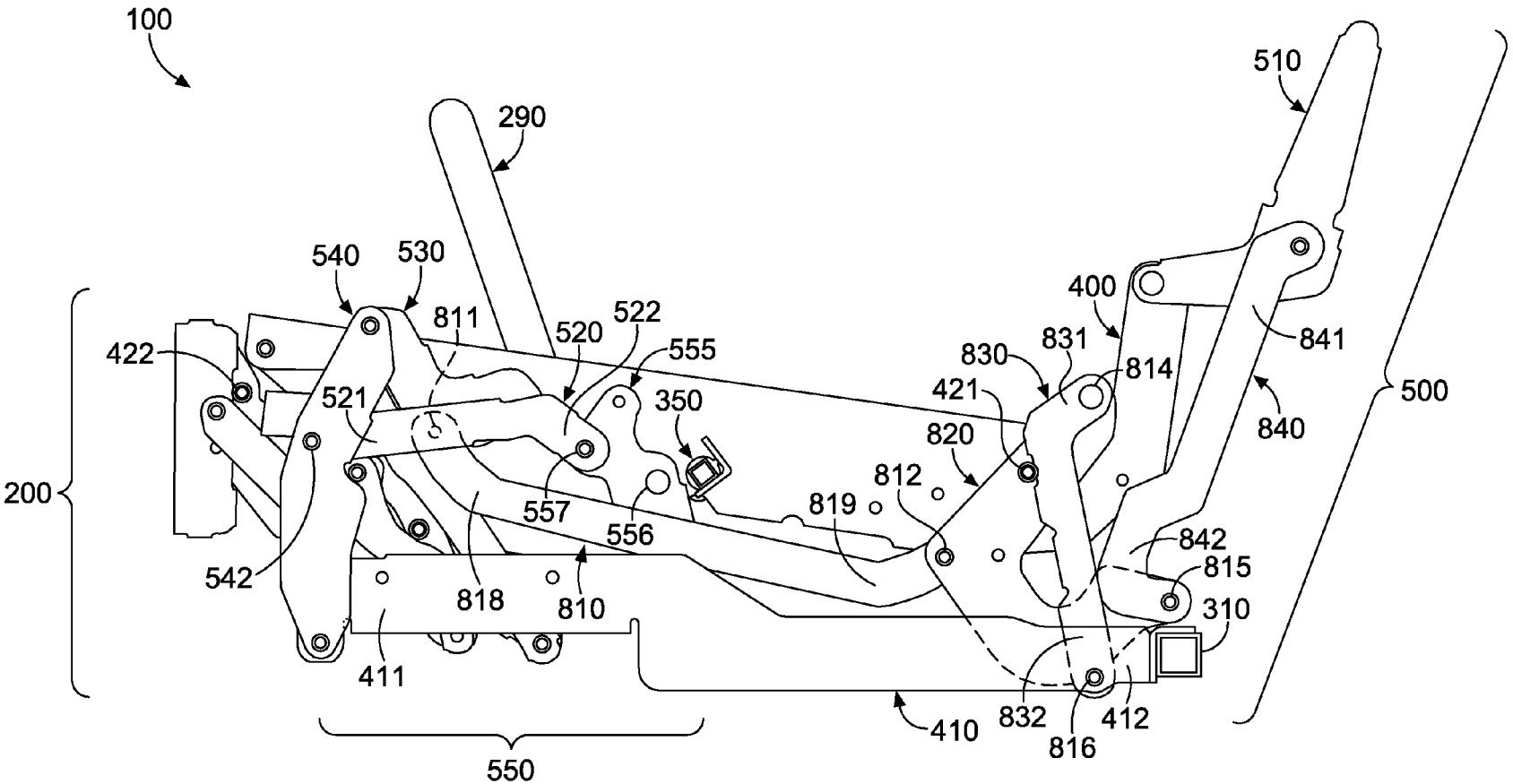
FIG. 7 is a diagrammatic lateral view of the manually operated linkage mechanism in the closed position from a vantage point internal to the recliner, in accordance with an embodiment of the present invention.

FIGS. 4-11 illustrate the configuration of the linkage mechanism 100 for a manually or automatically adjustable, zero-wall clearance, three-position recliner (hereinafter the "recliner") that is designed to assemble to a high-leg style seating unit 10. As discussed above, the linkage mechanism 100 is arranged to articulably actuate and control movement of a seat, a backrest, and ottoman(s) of the recliner between the positions shown in FIGS. 4-11. That is, the linkage mechanism 100 is adjustable to a reclined position (FIGS. 10 and 11), an extended (TV) position (FIGS. 4-6, 8, and 9), and a closed position (FIG. 7). In the reclined position, as mentioned above, the backrest is rotated rearward and biased in a rearward inclination angle, which is an obtuse angle in relation to the seat. When the recliner is adjusted to the extended position, the ottoman(s) remain extended forward, while the backrest is angularly biased substantially perpendicular to the seat. The closed position is configured as a non-reclined sitting position with the seat in a generally horizontal position and the backrest remaining generally upright. During adjustment between the closed, extended, and reclined positions, the linkage mechanism 100 employs a seat-adjustment assembly 500 with a rear bellcrank 820 and a front lift assembly 550 with a front lift link 530 that operate in concert to translate a pair of seat-mounting plates 400 over respective base plates 410 in a consistent inclined orientation relative to the base plates 410. This translation of the seat-mounting plates 400 allows the recliner to achieve zero-wall clearance functionality, as discussed above.

Generally, the linkage mechanism 100 comprises a plurality of linkages that are arranged to actuate and control movement of the recliner during movement between the closed, the extended, and the reclined positions. Typically, in order to accomplish articulated actuation of the linkage mechanism 100, the linkages may be pivotably coupled to one or more other linkages or plates comprising the linkage mechanism 100. It is understood and appreciated that the pivotable couplings (illustrated as pivot points in the figures) between these linkages can take a variety of configurations, such as pivot pins, bearings, traditional mounting hardware, rivets, bolt and nut combinations, or any other suitable fasteners which are well-known in the furniture-manufacturing industry. Further, the shapes of the linkages and the brackets may vary, as may the locations of certain pivot points. It will be understood that when a linkage is referred to as being pivotably "coupled" to, "interconnected" with, "attached" on, etc., another element (e.g., linkage, bracket, frame, and the like), it is contemplated that the linkage and elements may be in direct contact with each other, or other elements, such as intervening elements, may also be present.

In operation, the linkage mechanism 100 guides the rotational movement of the backrest, the seat, and the ottoman(s). In an exemplary configuration, these movements are controlled by a pair of essentially mirror-image linkage mechanisms (one of which is shown herein and indicated by reference numeral 100), which comprise an arrangement of pivotably interconnected linkages. The linkage mechanisms are disposed in opposing-facing relation about a longitudinally-extending plane that bisects the recliner between the pair of opposed arms. As such, the ensuing discussion will focus on only one of the linkage mechanisms 100, with the content being equally applied to the other complimentary linkage assembly.

Figure 4:
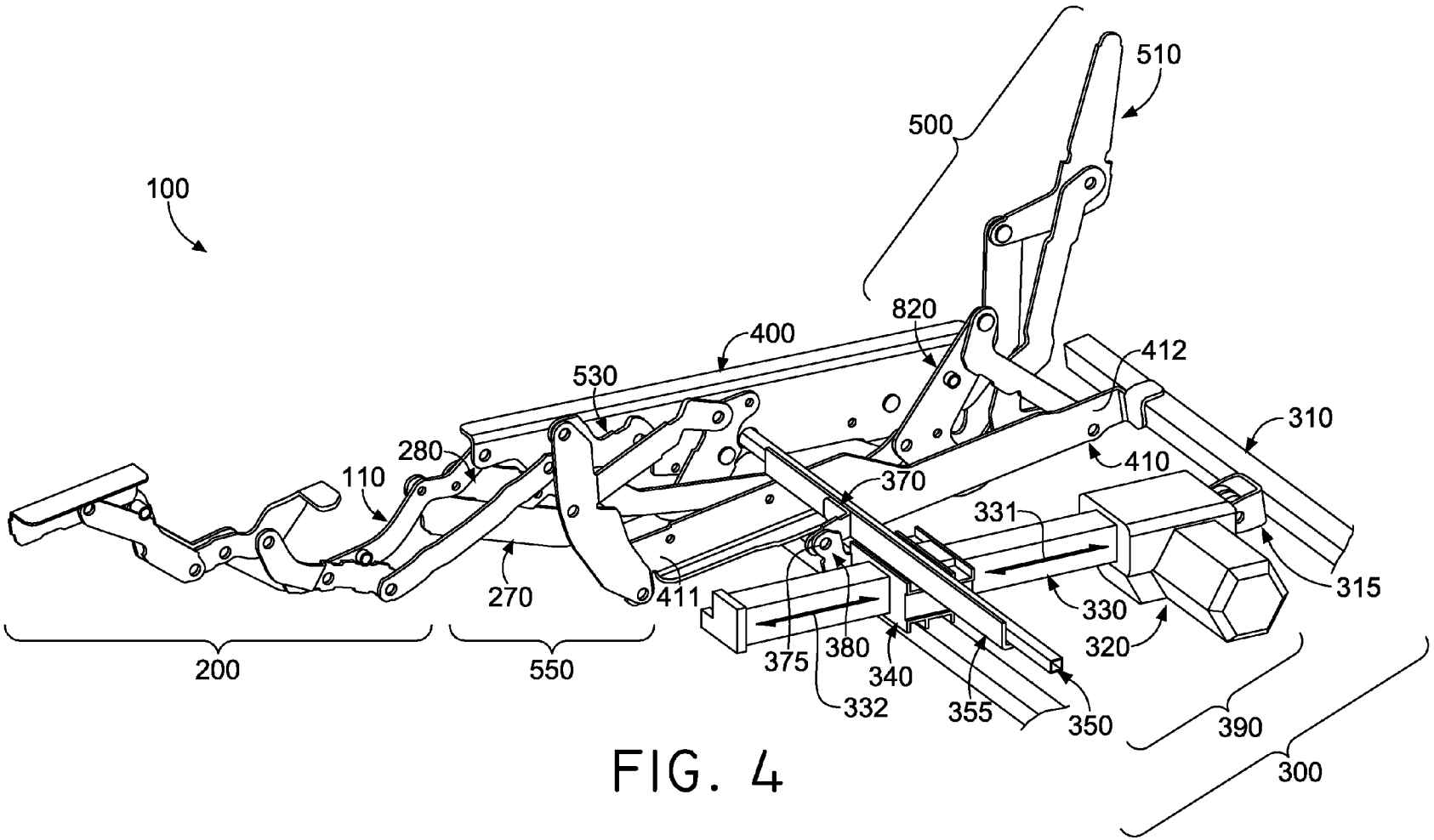
FIG. 4 is a perspective view of a linkage mechanism in the extended position that is automated by a linear actuator, in accordance with an embodiment of the present invention.

With particular reference to FIG. 4, a perspective view of the linkage mechanism 100 in the extended position is shown, in accordance with an embodiment of the present invention. In embodiments, the linkage mechanism 100 includes a footrest assembly 200, the seat-mounting plate 400, the base plate 410, the seat-adjustment assembly 500, and the front lift assembly 550. Footrest assembly 200 is comprised of a plurality of links arranged to extend and collapse the ottoman(s) during adjustment of the recliner between the extended position and the closed position, respectively. Seat-mounting plate 400 is configured to fixedly mount to the seat, and, in conjunction with an opposed seat-mounting plate, define a seat support surface (not shown). Seat-adjustment assembly 500 includes a back-mounting link 510, the rear bellcrank 820, and a plurality of other links. Generally, the seat-adjustment assembly 500 is adapted to recline and incline the backrest, which is coupled to the back-mounting link 510. Front lift assembly 550 includes the front lift link 530 and a plurality of other links. Generally, the front lift assembly 550 and the seat-adjustment assembly 500 are adapted to cooperate to laterally translate the seat, which is coupled to the seat-mounting plate 400. Further, in automated embodiments of the recliner, the front lift assembly 550 is coupled to links (e.g., ottoman drive link 280) that indirectly couple an activator bar 350 of a motor assembly 300 to the footrest assembly 200, thereby facilitating movement of the recliner in response to actuation of a linear actuator 390 within the motor assembly 300.

As mentioned previously, with reference to FIG. 4, the linkage mechanism 100 may be coupled to the motor assembly 300, which provides powered adjustment of the linkage mechanism 100 between the reclined, the extended, and the closed positions. The motor assembly 300 includes a chassis tube 310, a motor bracket 315, a motor mechanism 320, a track 330, a motor activator block 340, the activator bar 350, an angle bracket 355, a first motor link 370, and a second motor link 380. The motor mechanism 320 and the motor activator block 340 are slidably connected via the track 330. This "linear actuator," depicted by reference numeral 390 and comprised of the motor mechanism 320, the track 330, and the motor activator block 340 is held in position and coupled to the linkage mechanism 100 by way of the chassis tube 310 and the activator bar 350. Generally, the chassis tube 310 and the activator bar 350 span between and couple together the linkage mechanism 100 shown in FIG. 1 and its counterpart, mirror-image linkage mechanism (not shown). The activator bar 350 may be rotatably coupled to the seat-mounting plate 400 via a bushing, bearing(s), or any other mechanism for facilitating a rotational couple, while the chassis tube 310 is rigidly secured on opposed ends to the respective linkage mechanisms 100.

In embodiments, the chassis tube 310 and the activator bar 350 function as a set of crossbeams and may be formed from square metal tubing. Alternatively, the seat-mounting plate 400, the base plate 410, and the plurality of links that comprise the linkage mechanism 100 are typically formed from metal stock, such as stamped, formed steel. However, it should be understood and appreciated that any suitable rigid or sturdy material known in the furniture-manufacturing industry may be used in place of the materials described above.

The chassis tube 310 is attached at opposed ends to the mirror-image linkage mechanisms 100 at a rearward portion 412 of the respective base plates 410. In addition, the chassis tube 310 is pivotably coupled at a mid section to a housing that protects the motor mechanism 320. The activator bar 350 includes a pair of opposed ends that are each rotatably coupled to the seat-mounting plates 400. In addition, the activator bar 350 is pivotably coupled at a mid section to the motor activator block 340 via one or more intervening motor links. In a particular embodiment, the motor links comprise an angle bracket 355 fixedly attached to the activator bar 350, a pair of first motor links 370 fixedly attached to the angle bracket 355 on opposed sides of the track 330, and a pair of second motor brackets 380 fixedly attached to the motor activator block 340 on opposed sides of the track 330. Typically, the angle bracket 355 is formed as an L-shaped beam that is longitudinally aligned with the activator bar 350, while the pair of first motor links 370 and the pair of second motor links 380 are disposed in substantially parallel-spaced relation to one another and orientated substantially perpendicular in relation to the angle bracket 355. As illustrated in FIG. 4, each of the first motor links 370 is pivotably coupled to a respective second motor link 380 at the pivot 375. This pivotable coupling of the motor links 370 and 380 is designed to induce the activator bar 350 to rotate during a first phase of adjustment of the linear actuator 390 and to translate during a second phase of adjustment, as described more fully below.

In operation, the motor mechanism 320 and the motor activator block 340 cause the motor activator block 340 to longitudinally traverse, or slide, along the track 330. This sliding action produces a rotational force or a lateral force, via the intervening motor links, on the activator bar 350, which, in turn, produces movement within the linkage mechanism 100. As more fully discussed below, the sliding action of the motor activator block 340, or stroke of the linear actuator 390, is sequenced into the first phase and the second phase. In an exemplary embodiment, the first phase and second phase are mutually exclusive in stroke. In other words, the linear-actuator stroke of the first phase fully completes before the linear-actuator stroke of the second phase commences, and vice versa.

Initially, the track 330 is operably coupled to the motor mechanism 320 and includes a first travel section 331 and a second travel section 332. The motor activator block 340 translates longitudinally along the track 330 under automated control of the motor mechanism 320 such that the motor activator block 340 translates within the first travel section 331 during the first phase and the second travel section 332 during the second phase. As illustrated in FIG. 4, a separation dividing the first travel section 331 and the second travel section 332 indicates that the travel sections 331 and 332 abut, however, they do not overlap. It should be realized that the precise length of the travel sections 331 and 332 is provided for demonstrative purposes only, and that the length of the travel sections 331 and 332, or ratio of the linear-actuator stroke allocated to each of the first phase and second phase, may vary from the length or ratio depicted.

Generally, the first phase involves longitudinal translation of the motor activator block 340 along the first travel section 331 of the track 330 while the motor mechanism 320 remains generally fixed in space, with respect to the base plate 410. This longitudinal translation creates both a torque and a lateral thrust at the activator bar 350, via the one or more intervening motor links. The torque rotatably adjusts the activator bar 350 while the lateral thrust translates it upward and forward with respect to the chassis tube 310. This rotation of the activator bar 350 invokes movement of the front ottoman link 110 via the ottoman drive link 280. The movement of the front ottoman link 110 invokes and controls adjustment of the footrest assembly 200 between the closed position and the extended position. The upward and forward translation of the activator bar 350 causes the seat-mounting plate 400, and likewise the seat, to translate forward during the first phase in concurrence with extending the footrest assembly 200 from the closed position to the extended position. Once a stroke of the first phase is substantially complete, the second phase occurs.

Generally, the second phase involves longitudinal translation of the motor activator block 340 along the second travel section 332 of the track 330 that creates a lateral thrust at the activator bar 350 via the intervening motor links. That is, the motor activator block 340 moves forward and upward with respect to the motor mechanism 320, which remains generally fixed in space. The lateral thrust translates the seat-mounting plate 400 forward and upward with respect to the base plate 410 that, in turn, invokes angular rotation of the rear bellcrank 820. The angular rotation of the rear bellcrank 820 invokes and controls adjustment of the seat-adjustment assembly 500 between the extended position and the reclined position. In a particular embodiment, the angular rotation of the rear bellcrank 820 reclines or inclines the back-mounting link 510, and likewise the backrest, while translating the seat-mounting plate 400 in a substantially consistent orientation throughout adjustment.

In embodiments, a weight of an occupant seated in the recliner and/or springs interconnecting links of the seat-adjustment assembly 500 and/or the front lift assembly 550 may assist in creating the sequence. Accordingly, the sequence ensures that adjustment of the footrest assembly 200 between the closed and extended positions is not interrupted by an adjustment of the backrest, and vice versa. In other embodiments (not shown), a sequencing assembly integrated within the linkage mechanism 100 may be provided to control the adjustment of the recliner.

In one instance, the combination of the motor mechanism 320, the track 330, and the motor activator block 340 may be embodied as an electrically powered linear actuator 390, as illustrated in FIG. 4. In this instance, the linear actuator 390 is controlled by a hand-operated controller that provides instructions to the linear actuator 390. These instructions may be provided upon detecting a user-initiated actuation of the hand-operated controller. Further, these instructions may cause the linear actuator 390 to carry out a complete first phase and/or second phase of movement. Or, the instructions may cause the linear actuator 390 to partially complete the first phase or the second phase of movement. As such, the linear actuator 390 may be capable of being moved to and maintained at various positions within a stroke of the first phase or the second phase, in an independent manner.

Although a particular configuration of the combination of the motor mechanism 320, the track 330, and the motor activator block 340 has been described, it should be understood and appreciated that other types of suitable devices that provide sequenced adjustment may be used, and that embodiments of the present invention are not limited to the linear actuator 390 as described herein. For instance, the combination of the motor mechanism 320, the track 330, and the motor activator block 340 may be embodied as a telescoping apparatus that extends and retracts in a sequenced manner.

With reference to FIGS. 5-11, the components of the linkage mechanism 100 will now be discussed in detail. As briefly mentioned above, the linkage mechanism 100 includes the footrest assembly 200, the seat-mounting plate 400, the base plate 410, the seat-adjustment assembly 500, and the front lift assembly 550. Generally, one or more legs are adapted to vertically raise and support the recliner above an underlying surface. In embodiments, the leg(s) (see reference numeral 26 of FIGS. 1-3) are mounted to the arms in the frame-within-a-frame style chair, while the leg(s) are mounted to an underlying arm base (not shown) in the pivot-over-arm style chair. A hardware chassis, of which the 310 chassis tube is a part, is mounted to either the arm or the underlying arm base. The base plate is mounted to the chassis tube(s) (e.g., both front and rear). The seat-mounting plate 400 is interconnected to the base plate via links comprising the seat-adjustment assembly 500 and the front lift assembly 550, which translate the seat over the base plate 410 during adjustment between the closed, extended, and reclined positions while maintaining a substantially consistent angle of inclination therebetween.

Figure 8:
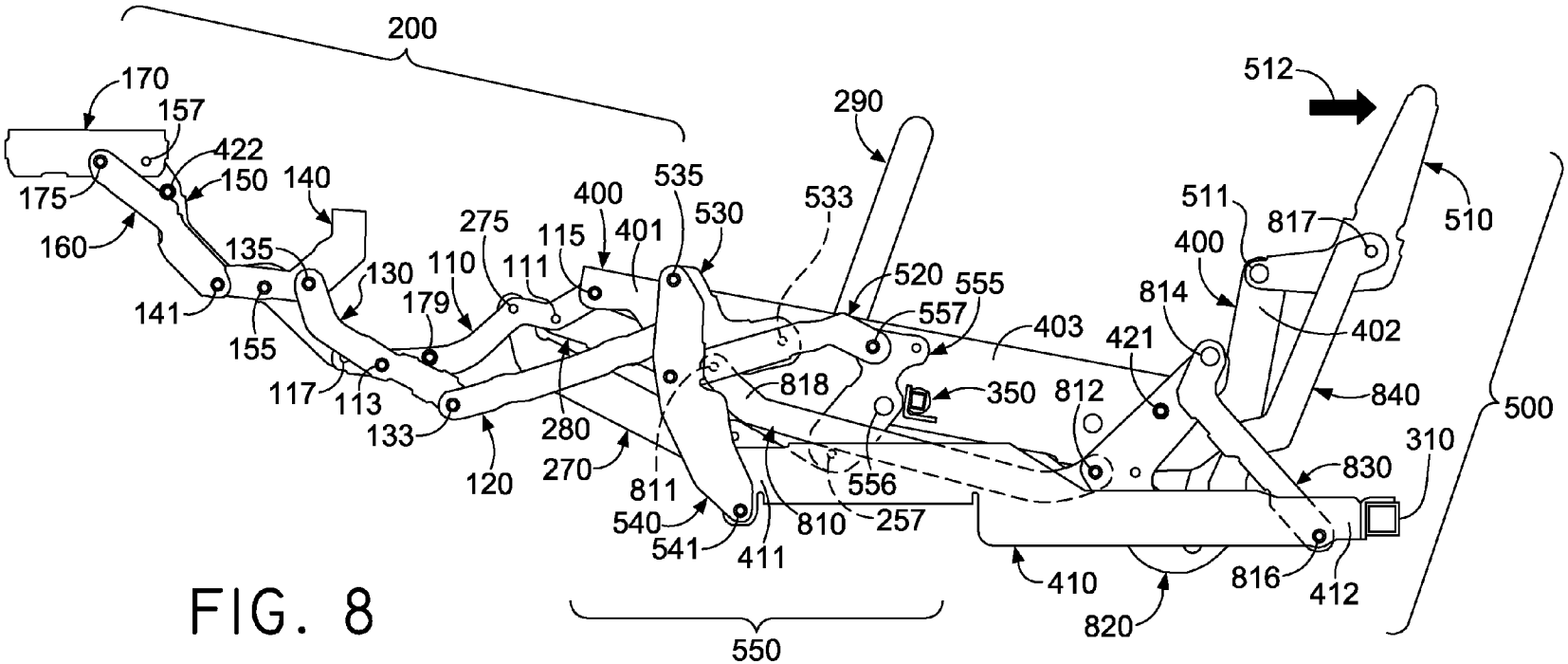
FIG. 8 is a view similar to FIG. 7, but in the extended position, in accordance with an embodiment of the present invention.
Figure 9:
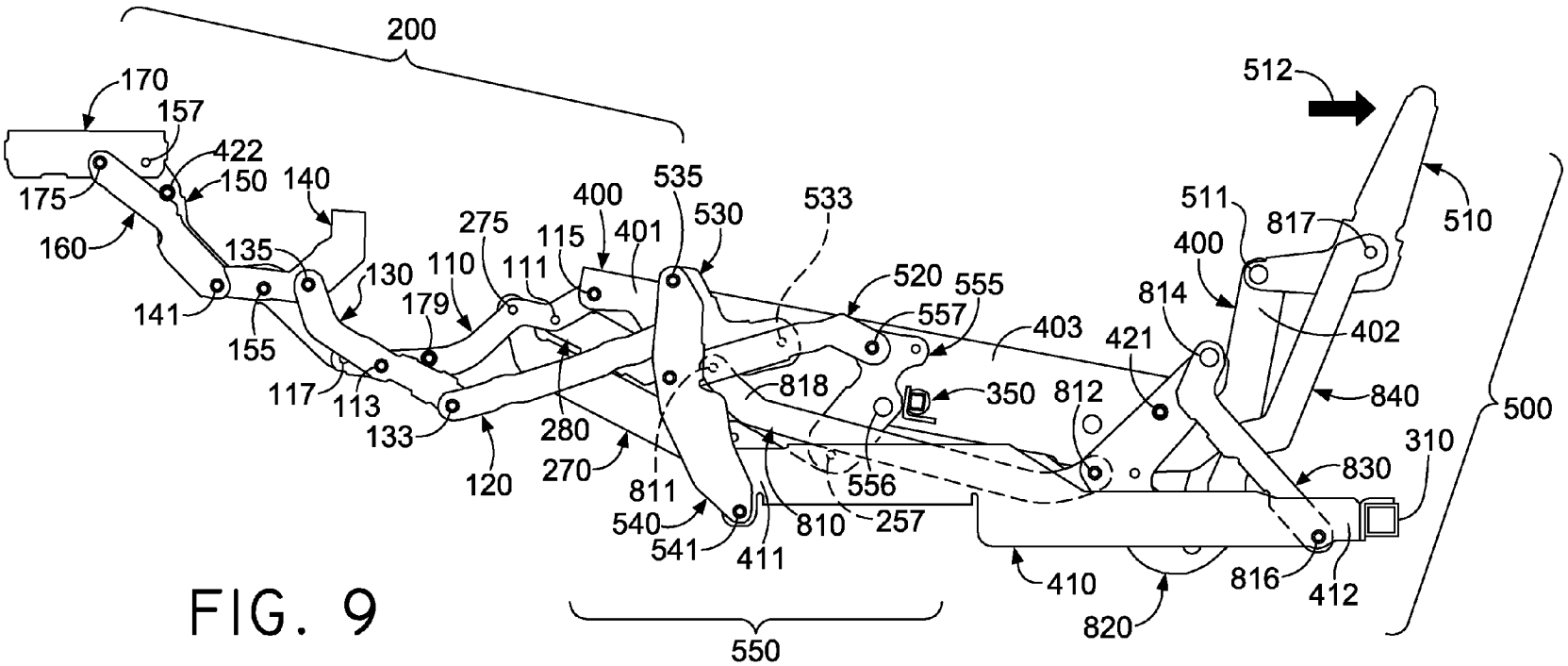
FIG. 9 is a view similar to FIG. 8, but illustrating the automated linkage mechanism, in accordance with an embodiment of the present invention.

The footrest assembly 200 includes a front ottoman link 110, a rear ottoman link 120, an outer ottoman link 130, a mid-ottoman bracket 140, an inner ottoman link 150, and upper ottoman link 160, and a footrest bracket 170. Referring to FIGS. 8 and 9, the front ottoman link 110 is rotatably coupled to a forward portion 401 of the seat-mounting plate 400 at pivot 115. The front ottoman link 110 is pivotably coupled to the outer ottoman link 130 at pivot 113 and a lower end the inner ottoman link 150 at pivot 117. Further, the front ottoman link 110 includes an intermediate stop element 179 for ceasing extension for the footrest assembly 200 from the closed position to the extended position upon an edge of the outer ottoman link 130 making contact with the intermediate stop element 179. Even further, the front ottoman link 110 is pivotably coupled to a front end 272 of a long lock link 270 at the pivot 275, and to a forward end of the ottoman drive link 280 at the pivot 111, as discussed more fully below.

The rear ottoman link 120 is rotatably coupled to the forward portion 401 of the seat-mounting plate 400 at pivot 121 (see FIG. 5) and is pivotably coupled to a lower end of the outer ottoman link 130 at pivot 133. In an exemplary embodiment, the pivot 121 of the rear ottoman link 120 is located rearward in relation to the pivot 115 of the front ottoman link 110. The outer ottoman link 130 includes the lower end pivotably coupled to the rear ottoman link 120 at the pivot 133, a mid portion pivotably coupled to the front ottoman link 110 at the pivot 113, and an upper end pivotably coupled to the mid-ottoman bracket 140 at pivot 135. The mid-ottoman bracket 140 includes a straight end pivotably coupled to a lower end of the upper ottoman link 160 at pivot 141, a mid portion being rotatably coupled to a mid portion of the inner ottoman link 150 at pivot 155 and being pivotably coupled to an upper end of the outer ottoman link 130 at the pivot 135, and an angled end that is typically connected to the second foot-support ottoman (see reference numeral 47 of FIG. 2).

With continued reference to FIGS. 8 and 9, the inner ottoman link 150 includes the lower end pivotably coupled to the front ottoman link 110 at the pivot 117, the mid portion pivotably coupled to the mid portion of the mid-ottoman bracket 140 at the pivot 155, and an upper end pivotably coupled to the footrest bracket 170 at pivot 157. Further, the inner ottoman link 150 includes a front stop element 422 for retraining extension for the footrest assembly 200. In operation, the front stop element 422 contacts an edge of a mid portion of the upper ottoman link 160 when the linkage mechanism 100 is adjusted to the extended position, thereby resisting further extension of the footrest assembly 200. The upper ottoman link 160 includes the lower end pivotably coupled to the mid-ottoman bracket 140 at the pivot 141, an upper end pivotably coupled to a mid portion of the footrest bracket 170 at pivot 175, and the mid portion that may contact the front stop element 422 upon achieving full adjustment to the extended position.

The footrest bracket 170 includes one end rotatably coupled to the upper end of the inner ottoman link 150 at the pivot 157, and the mid portion pivotably coupled to the upper end of the upper ottoman link 160 at the pivot 175. Typically, the footrest bracket 170 is also connected to the first foot-support ottoman (see reference numeral 45 of FIG. 2). In an exemplary embodiment, the first and second foot-support ottomans are disposed in generally horizontal orientations when in the extended position and the reclined position.

In an exemplary embodiment, the front ottoman link 110 of the footrest assembly 200 is also pivotably coupled to both a long lock link 270 at pivot 275 and the ottoman drive link 280 at pivot 111. With reference to FIGS. 6 and 8 that depict the manual-actuation embodiment of the linkage mechanism 100, the long lock link 270 is pivotably coupled at a front end 272 to a mid portion 112 of the front ottoman link 110 at the pivot 275 and at a back end 271 to the short lock link 260 at pivot 256. In addition, the long lock link 270 includes a release stop element 287 extending from a mid portion thereof. On one end, the short lock link 260 is pivotably coupled to the long lock link 270 at the pivot 256, and, at an opposed end, the short lock link 260 is fixedly attached to an end of the activator bar 350 that extends through its rotatable coupling to the seat-mounting plate 400.

In the manual-actuation embodiment, which does not include the linear actuator 390 and relies on a manual actuation by an occupant of the recliner (e.g., with the aid of springs) to initiate adjustment, an actuator plate 290 is employed to invoke extension of the footrest assembly 200 from the closed position to the extended position. The actuator plate 290 may include a handle portion 292, a mid portion 291 rotatably coupled to a mid section 403 of the seat-mounting plate 400 at pivot 285, and a lower contact edge 293 (hidden from view). The handle portion 292 extends generally upward from the actuator plate 290. Typically, the handle portion 292 is configured to receive a manual actuation from an occupant of the recliner when attempting to adjust the linkage mechanism 100 from the closed position to the extended position.

In operation, the occupant's manual actuation at the handle portion 292 may be a rearward force 905 that rotates the actuator plate 290 in a counter-clockwise direction, with reference to FIG. 6, causing the lower contact edge 293 to push forward the release stop element 287 on the long lock link 270. This forward push, in turn, initiates the extension of the footrest assembly 200 from the closed to the extended position by rotating the short lock link 260 out of an over-center locked position and allows the spring and/or occupants weight to translate the long lock link 270 forward and apply a linear force upon the front ottoman link 110.

In embodiments, the linear force directed through the long lock link 270 acts on the pivot 275 such that the front ottoman link 110 is rotated forward about the pivot 115 causing the footrest assembly 200 to extend. The forward rotation of the front ottoman link 110 prompts forward rotation of the rear ottoman link 120 about the pivot 121. Generally, as a result of the configuration of the pivots 133 and 113, the front ottoman link 110 and the rear ottoman link 120 rotate in substantial parallel-spaced relation. The rotation of the front ottoman link 110 and the rear ottoman link 120 generate upward movement of the inner ottoman link 150 and the outer ottoman link 130, respectively.

During their upward movements, the inner and outer ottoman links 150 and 130, respectively, operate in conjunction to raise and rotate the mid-ottoman bracket 140 and the footrest bracket 170 to generally horizontal orientations. Completion of the extension of the footrest assembly may be driven by springs and/or weight of the occupant within the recliner. As a result of adjustment within the first phase, the first foot-support ottoman 45 (see FIG. 2), supported by the footrest bracket 170, and the second foot-support ottoman 47, supported by the mid-ottoman bracket 140, are movable from positions below the seat support surface to extended, horizontally-orientated positions.

In one embodiment, an arcuate slot 283 may be provided within the mid portion 291 of the actuator plate 290 that captures a stop element 284 attached to the mid section 403 of the seat-mounting plate 400. Contact between one of the two ends of the arcuate slot 283 and the stop element 284 limits the rotation of the actuator plate 290 about the pivot 285. Thus, interaction between the stop element 284 and the arcuate slot 283 restrict a distance of throw of the handle portion 292 of the actuator plate 290 when the rearward force 905 is applied by the recliner occupant.

It will be appreciated and understood that, besides providing the handle portion 292 to receive direct manual actuation, various other configurations of the actuator plate 290 are contemplated that allow an occupant to trigger actuation of the footrest assembly 200. For instance, an adaptation of the actuator plate 290 to receive a cable is contemplated by embodiments of the instant invention, where the cable is manipulated by a release level of a cable-actuation mechanism assembled to the recliner.

With reference to FIGS. 5 and 9 that depict the automated-actuation embodiment of the linkage mechanism 100 and employ the linear actuator 390 of FIG. 4. Typically, the ottoman drive link 280 is pivotably coupled to the lower end of the front bellcrank 555 at the pivot 257 and is pivotably coupled at a forward end to the front ottoman link 110 at the pivot 111. As mentioned above, the short lock link 260 is fixedly attached to an end of the activator bar 350 that extends through its rotatable coupling (e.g., bearing) to the seat-mounting plate 400. Accordingly, the short lock link 260 operates as a pivoting arm that is controlled by rotational adjustment of the activator bar 350.

In operation, rotation of the activator bar 350 in the first phase causes rotation of the short lock link 260. The inter-coupling of short lock link 260 and the long lock link 270 converts a torque exerted by the linear actuator 390 (rotational force) applied to the activator bar 350, into a forward and upward push (directional force) that acts on the pivot 275 of the footrest assembly 200. That is, a counterclockwise moment applied to the activator bar 350, with reference to FIG. 6, is transferred into an upward and forward translation of the ottoman drive link 280 that initiates extension of the footrest assembly 200 from the closed position to the extended position. Continued forward translation of the ottoman drive link 280, in turn, maintains a linear force at the pivot 111, which further pushes the ottoman outward along with the seat to the reclined position. Accordingly, rotational speed of the activator bar 350 (controlled by the linear actuator 390) influences the rate at which the foot-support ottoman(s) extend from below the seat support surface. Retraction of the footrest assembly 200 is triggered by a clockwise moment at the activator bar 350 that pulls the ottoman lock link 270 in a downward and rearward translation. Generally, this downward and rearward translation invokes movement of the footrest assembly 200 that is reverse to the steps discussed above with reference to the extension operation.

As discussed above, the front ottoman link 110 of the footrest assembly 200 is pivotably coupled to both the ottoman drive link 280 at the pivot 111 and the long lock link 270 at the pivot 275. In embodiments above, the upward and forward directional force applied to extend the footrest assembly 200 is directed to the front ottoman link 110 at pivot 111 or 275, as opposed to the rear ottoman link 120. Thus, the configurations of the footrest assembly 200 illustrated in FIGS. 4-11, unlike traditional four-bar extension mechanisms, promote significant extension of the ottoman(s) while enabling a compact collapsed size of the footrest assembly 200 when in the closed position. This compact collapsed size allows the footrest assembly 200 to be located below the seating support surface and above a lower surface of at least one crossbeam (e.g., chassis tube 310) when in the closed position. By folding into this compact collapsed size, the footrest assembly 200 is hidden between the arms of the recliner. As such, a furniture designer can supply the recliner with high legs, so that the recliner resembles a traditional-chair-type seating unit, or can lower a chassis of the recliner to the underlying surface without creating an interference when adjusting the footrest assembly 200. Because the footrest assembly 200 is hidden in the closed position, these aesthetically pleasing configurations of a fully operational recliner are possible.

With continued reference to FIGS. 4-11, the seat-adjustment assembly 500 will now be discussed in accordance with an embodiment of the present invention. Generally, the seat-adjustment assembly 500, in cooperation with the front-lift assembly 550, provides for straight-line translation of the seat-mounting plate 400 over the base plate 410 during movement in the second phase (adjusting between the extended and reclined positions). The seat-adjustment assembly 500 includes a rear control link 810, a rear bellcrank 820, a seat plate strap 825, the rear pivot link 830, a back control link 840, and the back-mounting link 510. Initially, as best illustrated in FIGS. 8 and 9, the rear control link 810 includes a front end 818 pivotably coupled to a front lift link 530 of the front-lift assembly 550 at pivot 811, and a rearward end 819 pivotably coupled to the rear bellcrank 820 at pivot 812. The rear bellcrank 820 is rotatably coupled to the seat plate strap 825 at pivot 813 (see FIG. 5). In an exemplary embodiment, the seat plate strap 825 is configured as a V-shaped member comprising two upper ends 828 and 827 fixedly attached to the seat-mounting plate 400 at, at least, two locations, such as connections 826 and 829, respectively. Further, the seat plate strap 825 may include a lower elbow portion 801 between the upper ends 827 and 828. In one instance, the pivot 813 that rotatably couples the rear bellcrank 820 to the seat plate strap 825, and thus to the seat-mounting plate 400, is located within the lower elbow portion 801.

Although one configuration of the seat plate strap 825 is illustrated and described, is should be appreciated and understood that any shape of link or combination of links that serve as a lower extension of the seat-mounting plate 400 may be employed in place of the seat plate strap 825. For instance, the seat plate strap 825 may be merely a segment of the seat-mounting plate 400 itself that extends downward from the rear portion 402 of the seat-mounting plate 400.

Figure 11:
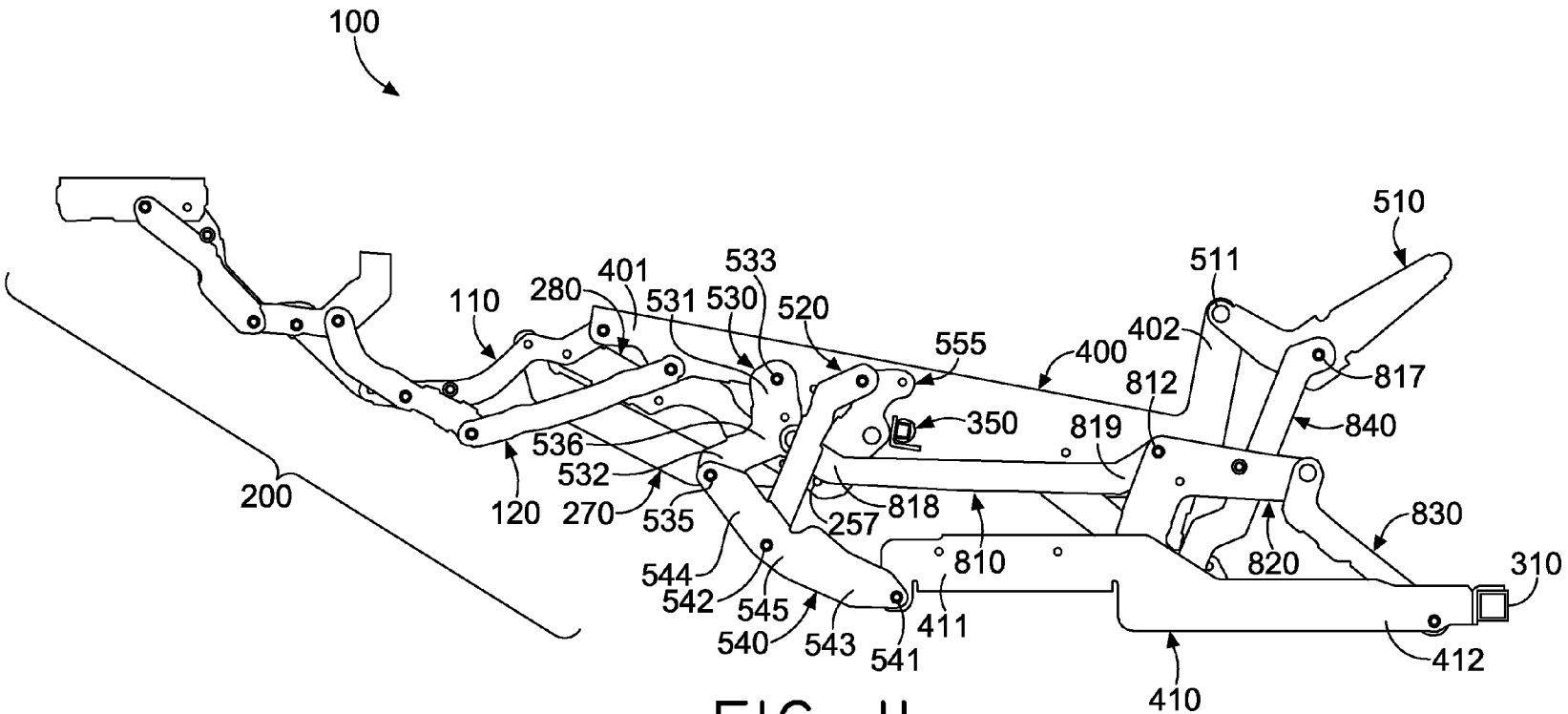
FIG. 11 is a view similar to FIG. 10, but illustrating the automated linkage mechanism, in accordance with an embodiment of the present invention.

With reference to FIG. 11, the rear bellcrank 820 will be described in detail. In an exemplary embodiment, the rear bellcrank 820 is configured as a U-shaped plate that includes a first end 821 (see FIG. 14), an elbow 823, a second end 822, and a mid section 824 at which the pivot 813 is located. The elbow 823 of the rear bellcrank 820 is pivotably coupled to the rearward end 819 of the rear control link 810 at the pivot 812. The first end 821 of the rear bellcrank 820 is pivotably coupled to an upper end 831 (see FIG. 7) of the rear pivot link 830 at pivot 814. The second end 822 of the rear bellcrank 820 is pivotably coupled to a lower end 842 (see FIG. 7) of the back control link 840 at pivot 815.

The rear pivot link 830 is rotatably coupled at a lower end 832 to a rearward portion 412 of the base plate 410 at pivot 816 and is pivotably coupled at the upper end 831 to the rear bellcrank 820 at the pivot 814 (see FIG. 7). The back control link 840 is pivotably coupled at the lower end 842 to the rear bellcrank 820 at the pivot 815 and is pivotably coupled at an upper end 841 to the back-mounting link 510 at pivot 817. The back-mounting link 510 is rotatably coupled to the back control link 840 at the pivot 817 and is pivotably coupled at the rearward portion 402 of the seat-mounting plate 400 at pivot 511.

Figure 12:
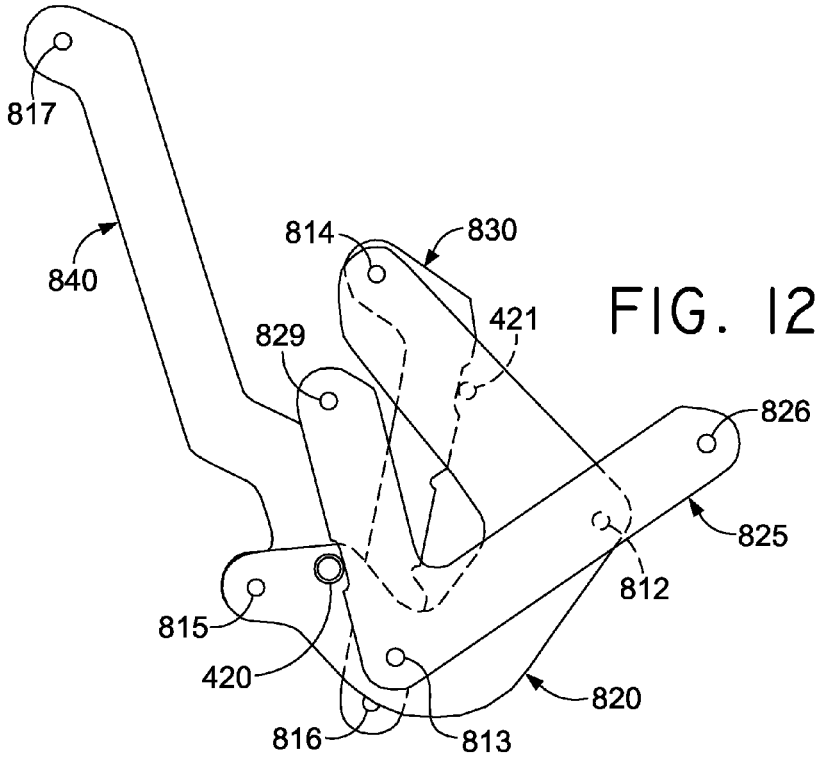
FIG. 12 is a partial side-elevation view of the linkage mechanism in the closed position highlighting a rear bellcrank within a seat-adjustment assembly, in accordance with an embodiment of the present invention.

With reference to FIGS. 12-15, the interoperation of the rear bellcrank 820, the rear pivot link 830, and the back control link 840 will now be discussed. FIG. 12 illustrates the links 820, 830, and 840 adjusted to the closed position. In the closed position, rear stop element 420 attached to the second end 822 of the rear bellcrank 820 may contact an edge of the lower elbow portion 801 of the seat plate strap 825. Also, an interior mid stop element 421 (see FIG. 7) attached to the first end of the rear bellcrank 820 may contact an edge of the upper end 831 of the rear pivot link 830. These contacts prevent further counterclockwise rotation of the rear bellcrank, with reference to FIG. 7, and, accordingly, control an orientation of the back-mounting link 510 when inclined and upright.

Figure 13:
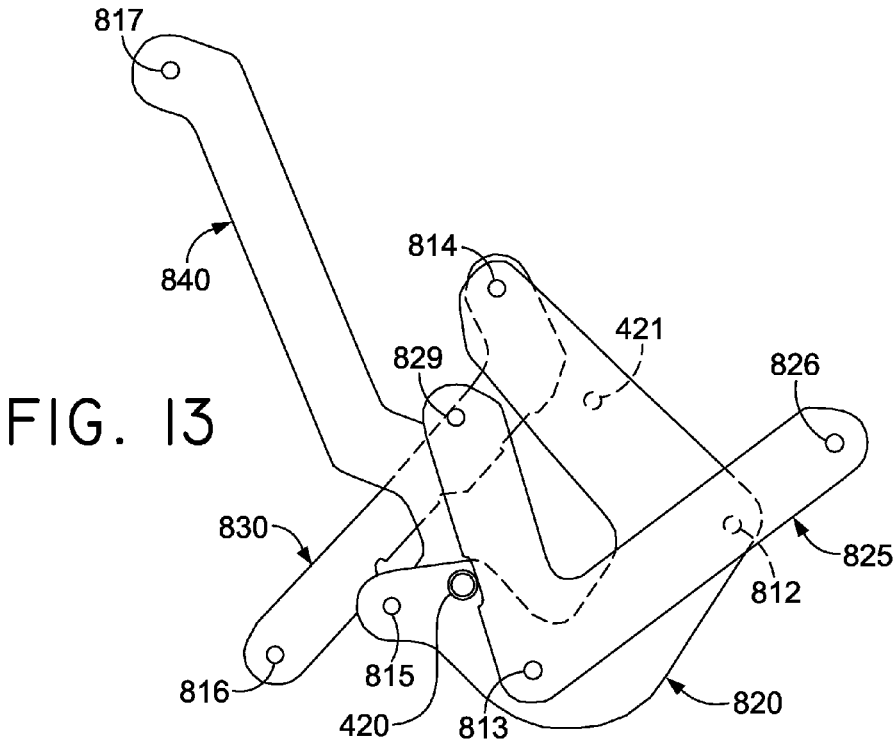
FIG. 13 is a view similar to FIG. 12, but in the extended position, in accordance with an embodiment of the present invention.

During the first phase of adjustment, the links 820, 830, and 840 may move to the extended position, as illustrated in FIG. 13. As shown, the back control link 840 remains substantially upright, thus, holding the back-mounting link 510 and, by extension, the backrest in the inclined orientation. However, the rear pivot link 830 is slightly tilted to allow forward movement of the seat. This forward movement of the seat is minimal, yet assists with the zero-wall clearance functionality.

During the second phase of adjustment, the links 820, 830, and 840 may move to the reclined position, as illustrated in FIGS. 14 and 15. As shown, the rear bellcrank 820 rotates in a counterclockwise fashion (see FIG. 14) pulling the back control link 840 downward, thus, reclining the back-mounting link 510 and, by extension, the backrest. This counterclockwise rotation of the rear bellcrank 820 also pushes rearward on the rear pivot link 830 at the pivot 814. The rear pivot link 830 transmits the rearward push to the pivot 816 on the base plate 410. Consequently, a pulling action is generated that separates the pivots 813 and 816 causing the seat-mounting plate 400 to translate forward over the base plate 410. In particular, this forward translation translates the seat-mounting plate 400 a suitable distance toward a front of the recliner such that the backrest avoids interference with a wall adjacent to a rear of the recliner.

One contributing factor to the above-described range of movement produced by the links 820, 830, and 840 is the location of the pivot 813. Specifically, the pivot 813 is located below a principal body the seat-mounting plate 400 on a segment (e.g., seat plate strap 825) extending downward therefrom. In operation, the lowered location of the pivot 813 allows for a longer rear pivot link 830 that can accomplish translating the seat-mounting plate 400 the suitable distance forward to achieve zero-wall clearance while avoiding interference with a bottom of the seat of the recliner.

With reference to FIGS. 4-11, the front-lift assembly 550 will now be discussed. The front-lift assembly 550 serves, in part, to guide the translation of the seat-mounting plate 400 while the linkage mechanism 100 is adjusted between the closed, extended, and reclined positions. In an exemplary embodiment, the front-lift assembly 550 in cooperation with the seat-adjustment assembly 500, translates the seat-mounting plate 400 in a substantially consistent orientation of inclination, with respect to the base plate 410 of the linkage mechanism 100. In this way, the front-lift assembly 550 translates the seat-mounting plate 400 upward and forward when adjusting the linkage mechanism 100 from the closed to the reclined position, and, conversely, translates the seat-mounting plate 400 downward and rearward when adjusting the linkage mechanism 100 from the reclined to the closed position.

Figure 10:
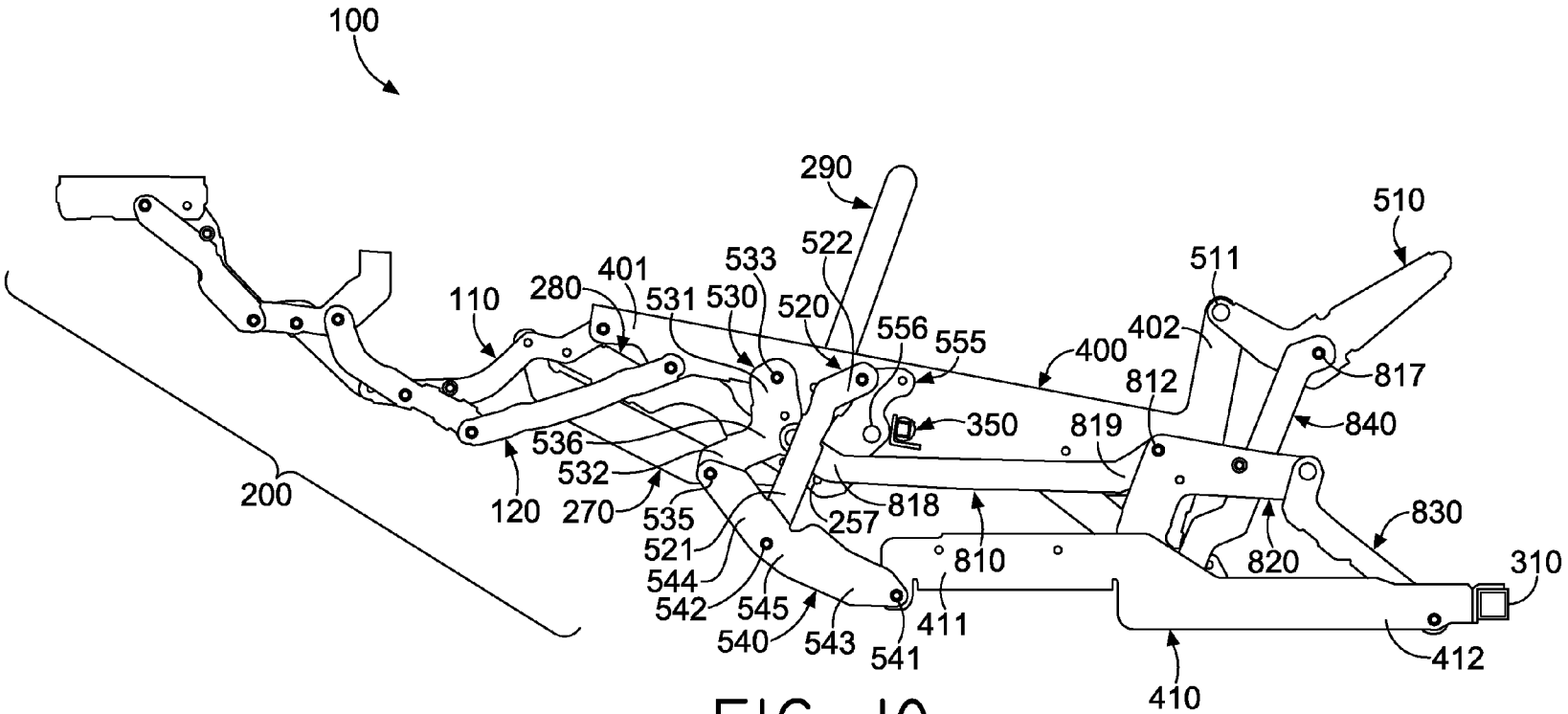
FIG. 10 is a view similar to FIG. 7, but in the reclined position, in accordance with an embodiment of the present invention.

As illustrated in FIGS. 7, 8, and 10, the front lift assembly 550 includes a carrier link 520, a front lift link 530, the front pivot link 540, and a front bellcrank 555. Initially, the front pivot link 540 includes an upper end 544, a mid portion 545, and a lower end 543. The front pivot link 540 is pivotably coupled at the upper end 544 to a first end 532 of the front lift link 530 at pivot 535. Further, the front pivot link 540 is pivotably coupled at the mid portion 545 to a front end 521 of the carrier link 520 at pivot 542. Even further, the front pivot link 540 is rotatably coupled at the lower end 543 to a forward portion 411 of the base plate 410 at pivot 541.

The front lift link 530 includes the first end 532, a second end 531, and a mid portion 536. As assembled to the front lift assembly, the front lift link 530 is pivotably coupled at the first end 532 to the upper end 544 of the front pivot link 540 at the pivot 535. Also, the front lift link 530 is rotatably coupled at the second end 531 to the seat-mounting plate 400 at pivot 533 and is pivotably coupled at the mid portion 536 to the front end 818 of the rear control link 810 at the pivot 811. The carrier link 520 is pivotably coupled at the front end 521 to the front pivot link 540 at the pivot 542 and is pivotably coupled at a back end 522 to the front bellcrank 555 at pivot 557. The front bellcrank 555 is pivotably coupled to the carrier link 520 at the pivot 557, is rotatably coupled at a mid portion to the mid section 403 of the seat-mounting plate 400 at pivot 556, and is pivotably coupled to the ottoman drive link 280 at pivot 257 (see FIG. 5).

In operation, when adjusting from the extended position to the reclined position in the second phase, the front lift assembly 550 and the seat-adjustment assembly 500 move in sequence, via the interconnecting rear control link 810, to translate the seat-mounting plate 400 forward over the base plate 410. In the manual-actuation embodiment, adjustment to the reclined position is invoked upon an occupant of the recliner pushing on the backrest, thereby imposing a rearward force 512 that rearwardly biases the back-mounting link 510. In one instance, the rearward force 512 should overcome a balance threshold in order to enable movement from the extended position to the reclined position, where the balance threshold is defined by a ratio of the rearward force 512 on the backrest to a downward occupant weight on the seat.

Upon overcoming the balance threshold, the back-mounting link 510 is biased rearwardly and moves the back control link 840 downward, thus, applying a downward directional force on the rear bellcrank 820 at the pivot 815. The rear bellcrank 820 converts the downward directional force into a moment about the pivot 813, which couples the rear bellcrank 820 to the seat-mounting plate 400. This moment induces a pushing action on the rear pivot link 830 at the pivot 814 (causing the seat-mounting plate 400 to translate forward over the base plate 410) and a pulling action on the rear control link 810 at the pivot 812 (causing the rear control link 810 to shift rearward and rotate the front lift link 530 of the front lift assembly 550).

The rotation of the front lift link 530 about the pivot 533, induced by the rearward shift of the rear control link 810, applies a downward directional force on the base plate 410 at the pivot 541, via the front pivot link 540. Also, the rotation of the front lift link 530 about the pivot 533 applies an upward directional force on the seat-mounting plate 400 at the pivot 533. As such, the rotation of the front lift link 530 causes separation between the forward portion 401 of the seat-mounting plate 400 and the forward portion 411 of the base plate and, in effect, guides the front of the seat upward as it translates forward while the back rest reclines.

In the automated-actuation embodiment shown in FIG. 4, when adjusting from the extended position to the reclined position in the second phase, the motor activator block 340 translates longitudinally along the track 330 under automated control over the second travel section 332 while the motor mechanism 320 remains coupled in place to the chassis tube 310. As discussed above, the motor activator block 340 is indirectly coupled to the activator bar 350, which moves forward and upward with the motor activator block 340 during its translation in the second travel section 332. This forward and upward movement of the activator bar 350 translates the seat-mounting plate 400 in a similar direction. Translation of the seat-mounting plate 400 acts on the rear bellcrank 820 at the pivot 813. At the same time, the base plate 410 remains immobile such that the rear pivot link 830 that inter-couples the base plate 410 to the rear bellcrank 820 causes rotation of the rear bellcrank 820 about the pivot 813. As discussed above, with reference to the manual-actuation embodiment, rotation of the rear bellcrank 820 invokes movement in the front lift assembly 550 via the rear control link 810. As such, the rear bellcrank 820 of the seat-adjustment assembly 500 and the front lift link 530 of the front lift assembly 550 operate concurrently to maintain a consistent angle of the seat during translation over the base plate 410.

It should be understood that the construction of the linkage mechanism 100 lends itself to enable the various links and brackets to be easily assembled and disassembled from the remaining components of the recliner. Specifically the nature of the pivots and/or mounting locations, allows for use of quick-disconnect hardware, such as a knock-down fastener. Accordingly, rapid disconnection of components prior to shipping, or rapid connection in receipt, is facilitated.

The present invention has been described in relation to particular embodiments, which are intended in all respects to be illustrative rather than restrictive. Alternative embodiments will become apparent to those skilled in the art to which the present invention pertains without departing from its scope.

It will be seen from the foregoing that this invention is one well adapted to attain the ends and objects set forth above, and to attain other advantages, which are obvious and inherent in the device. It will be understood that certain features and subcombinations are of utility and may be employed without reference to other features and subcombinations. This is contemplated by and within the scope of the claims. It will be appreciated by persons skilled in the art that the present invention is not limited to what has been particularly shown and described hereinabove. Rather, all matter herein set forth or shown in the accompanying drawings is to be interpreted as illustrative and not limiting.

What is claimed is:

1. A seating unit, comprising:

a pair of base plates in substantially parallel-spaced relation;

a pair of seat-mounting plates in substantially parallel-spaced relation, wherein each of the seat-mounting plates is disposed in an inclined orientation in relation to each of the base plates, respectively; and a pair of generally mirror-image linkage mechanisms each moveably interconnecting each of the base plates to a respective seat-mounting plate, and adapted to adjust between a closed position, an extended position, and a reclined position, wherein each of the linkage mechanisms comprise:

(a) a back-mounting link that supports a backrest, wherein the back-mounting link is rotatably coupled to a respective seat-mounting plate;

(b) a member that extends downward from a rear portion of a respective seat-mounting plate;

(c) a rear pivot link that includes an upper end and a lower end, wherein the lower end of the rear pivot link is rotatably coupled to a respective base plate;

(d) a back control link that includes an upper end and a lower end, wherein the upper end of the back control link is pivotably coupled to the back-mounting link; and (e) a rear bellcrank that is rotatably coupled to the member and pivotably coupled to the lower end of the back control link and to the upper end of the rear pivot link.

2. The seating unit of claim 1, wherein the pivotable coupling of the back control link, the rear pivot link, and the rear bellcrank is adapted to translate the seat-mounting plates over the base plates during adjustment between the closed position, the extended position, and the reclined position while maintaining the inclined orientation relationship therebetween.

3. The seating unit of claim 2, wherein each of the base plates has a rearward portion and a forward portion that is raised above the rearward portion, wherein the lower end of the rear pivot link is rotatably coupled to the rearward portion of a respective base plate.

4. The seating unit of claim 3, wherein each of the linkage mechanisms further comprise a front lift assembly that maintains the inclined orientation relationship of a respective seat mounting plate with respect to a respective base plate, and wherein the front lift assembly is rotatably coupled to the forward portion of a respective base plate.

5. The seating unit of claim 4, wherein each of the linkage mechanisms further comprise a rear control link that includes a front end and a rear end, wherein the front end of the rear control link is pivotably coupled to the front lift assembly and the rear end of the rear control link is pivotably coupled to the rear bellcrank.

6. The seating unit of claim 1, further comprising a first foot-support ottoman, wherein each of the linkage mechanisms further comprise a footrest assembly that movably inter-couples the first foot-support ottoman to a respective seat-mounting plate.

7. The seating unit of claim 6, further comprising a chassis tube attached at opposed ends to the rearward portion of the base plates, respectively, wherein the chassis tube spans and couples the linkage mechanisms.

8. The seating unit of claim 7, further comprising an activator bar rotatably coupled at opposed ends to the seat-mounting plates, respectively, wherein angular rotation of the activator bar invokes adjustment of the footrest assembly.

9. The seating unit of claim 8, further comprising a linear actuator that moveably inter-couples the activator bar with respect to the chassis tube.

10. The seating unit of claim 9, wherein the linear actuation comprises:

a motor mechanism pivotably coupled to a mid section mid-section of the chassis tube;

a track operably coupled to the motor mechanism, wherein the track includes a first travel section and a second travel section; and a motor activator block that translates longitudinally along the track under automated control, wherein the motor activator block is pivotably coupled, via one or more motor links, to a mid section of the activator bar.

11. The seating unit of claim 10, wherein longitudinal translation of the motor activator block along the first travel section creates a torque at the one or more motor links, thereby rotatably adjusting the activator bar, the rotatable adjustment of the activator bar controls adjustment of the seating unit between the closed position and the extended position.

12. The seating unit of claim 10, wherein longitudinal translation of the motor activator block along the second travel section creates a lateral thrust at the one or more motor links thereby translating the activator bar, the translation of the activator bar controls adjustment of the seating unit between the extended position and the reclined position.

13. The seating unit of claim 7, further comprising a seating support surface extending between the seat-mounting plates, wherein the footrest assembly is comprised of a set of linkages that collapse when adjusted to the closed position such that the footrest assembly is substantially situated below the seating support surface and above a lower edge of the chassis tube in the closed position.

14. The seating unit of claim 6, further comprising a second foot-support ottoman, wherein the footrest assembly movably inter-couples the second foot-support ottoman to a respective seat-mounting plate.

15. The seating unit of claim 1, wherein the member is configured as a V-shaped, seat plate strap comprising two upper ends and a lower elbow portion intermediate to the two upper ends, wherein each of the two upper ends is fixedly attached to a respective seat-mounting plate while the rear bellcrank is rotatably coupled to the lower elbow portion.

16. A seating unit having a seat, a backrest, and at least one foot-support ottoman, the seating unit being adapted to move between a closed, an extended and a reclined position, the seating unit comprising:

a pair of base plates in substantially parallel-spaced relation, wherein the base plates are mounted to one or more legs that are adapted to vertically raise and support the base plates above an underlying surface;

a pair of seat-mounting plates in substantially parallel-spaced relation, wherein the seat-mounting plates translatably carry the seat over the base plates; and a pair of the generally mirror-image linkage mechanisms each moveably interconnecting each of the base plates to a respective seat-mounting plate, wherein each of the linkage mechanisms comprise a footrest assembly, a seat-adjustment assembly, and a front lift assembly, and wherein the front lift assembly comprises:

(a) a front bellcrank that is rotatably coupled to a mid section of a respective seat-mounting plate;

(b) a front pivot link that includes an upper end, a lower end, and a mid-portion, wherein the lower end of the front pivot link is rotatably coupled to a forward portion of a respective base plate;

(c) a carrier link that includes a front end and a rear end, wherein the front end of the carrier link is pivotably coupled to the mid portion of the front pivot link while the rear end of the carrier link is pivotably coupled to the front bellcrank; and (d) a front lift link that is rotatably coupled to the mid section of a respective seat-mounting plate, wherein the upper end of the front pivot link is pivotably coupled to the front lift link.

17. The seating unit of claim 16, wherein the seat-adjustment assembly comprises:

a rear bellcrank rotatably coupled to a rear portion of a respective seat-mounting plate strap??; and a rear control link that includes a front end and a rear end, wherein the front end of the rear control link is pivotably coupled to the front lift link while the rear end of the rear control link is pivotably coupled to the rear bellcrank.

18. The seating unit of claim 17, wherein the front lift assembly further comprises a ottoman drive link that includes a front end and a rear end, wherein the front end of the ottoman drive link is pivotably coupled to the footrest assembly while the rear end of the ottoman drive link is pivotably coupled to the front bellcrank.

19. The seating unit of claim 18, wherein the seat-adjustment assembly further comprises:

a back-mounting link that supports the backrest, wherein the back-mounting link is rotatably coupled to a respective seat-mounting plate;

a seat plate strap that extends downward from a rear portion of a respective base plate;

a rear pivot link that includes a lower end and an upper end, wherein the lower end of the rear pivot link is rotatably coupled to a respective base plate while the upper end of the rear pivot link is pivotably coupled to the rear bellcrank; and a back control link that includes an upper end and a lower end, wherein the upper end of the back control link is pivotably coupled to the back-mounting link while the lower end of the back control link is pivotably coupled to the rear bellcrank, and wherein the pivotable coupling of the rear bellcrank to the back control link and the rear pivot link maintains an inclined orientation relationship between the seat-mounting plates and the base plates, respectively, throughout adjustment of the linkage mechanism.

20. A linkage mechanism adapted to adjust a recliner between closed, extended and reclined positions, the linkage mechanism comprising:

a seat-mounting plate configured to accommodate a seat of the recliner;

a base plate that is vertically supported by one or more legs above an underlying surface;

a footrest assembly adapted to extend and retract at least one ottoman when the recliner is adjusted between the extended and closed positions, respectively;

a front lift assembly comprising:

(a) a front bellcrank that is rotatably coupled to the seat-mounting plate;

(b) a front pivot link that is rotatably coupled to the base plate;

(c) a carrier link that is pivotably coupled to the front pivot link and to the front bellcrank; and (d) a front lift link that is rotatably coupled to the seat-mounting plate and is pivotably coupled to the front lift link; and a seat-adjustment assembly that operates in cooperation with the front lift assembly to translate the seat-mounting plate over the base plate during adjustment between the closed, extended, and reclined positions while maintaining a substantially consistent angle of inclination therebetween, wherein the seat-adjustment assembly comprises:

(a) a back-mounting link configured to accommodate a backrest of the recliner, wherein the back-mounting link is rotatably coupled to the seat-mounting plate;

(b) a rear pivot link that is rotatably coupled to the base plate;

(c) a back control link that is pivotably coupled to the back-mounting link;

(d) a rear bellcrank that is rotatably coupled to a downwardly extending member of the seat-mounting plate and is pivotably coupled to the back control link and to the rear pivot link; and (e) a rear control link that is pivotably coupled to the front lift link and to the rear bellcrank.

* * * * *